US008031135B2

(12) United States Patent
Chung et al.

(10) Patent No.: US 8,031,135 B2
(45) Date of Patent: Oct. 4, 2011

(54) PLASMA DISPLAY APPARATUS AND DRIVING METHOD THEREOF

(75) Inventors: Moonshick Chung, Gyeongsangbuk-do (KR); Youngseop Moon, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 954 days.

(21) Appl. No.: 11/280,193

(22) Filed: Nov. 17, 2005

(65) Prior Publication Data

US 2006/0139247 A1 Jun. 29, 2006

(30) Foreign Application Priority Data

Dec. 23, 2004 (KR) ..... 10-2004-0111543

(51) Int. Cl.
*G09G 3/28* (2006.01)

(52) U.S. Cl. ..... 345/60; 345/63; 345/68; 315/169.4

(58) Field of Classification Search ..... 345/60–72; 315/169.4

See application file for complete search history.

(56) References Cited

U.S. PATENT DOCUMENTS

| | | | | |
|---|---|---|---|---|
| 6,249,087 | B1 * | 6/2001 | Takayama et al. | 315/169.1 |
| 7,145,523 | B2 * | 12/2006 | Hsu et al. | 345/60 |
| 7,477,209 | B2 * | 1/2009 | Wakabayashi et al. | 345/60 |
| 7,629,948 | B2 * | 12/2009 | Chung et al. | 345/60 |
| 7,705,801 | B2 * | 4/2010 | Fu et al. | 345/60 |
| 7,825,874 | B2 * | 11/2010 | Chung et al. | 345/60 |
| 2002/0190928 | A1 * | 12/2002 | Iwami et al. | 345/60 |
| 2003/0034937 | A1 * | 2/2003 | Kim | 345/63 |
| 2003/0095084 | A1 * | 5/2003 | Mizobata | 345/60 |
| 2005/0225508 | A1 * | 10/2005 | Chung et al. | 345/60 |

FOREIGN PATENT DOCUMENTS

| | | |
|---|---|---|
| JP | 2003-157043 A | 5/2003 |
| KR | 2002-0078988 A | 10/2002 |
| KR | 2002-0087770 A | 11/2002 |

* cited by examiner

*Primary Examiner* — Jason Mandeville

(74) *Attorney, Agent, or Firm* — Birch, Stewart, Kolasch & Birch, LLP

(57) ABSTRACT

The present invention relates to a plasma display apparatus and driving method thereof, in which an afterimage occurring when the plasma display panel is turned on can be obviated and an erroneous discharge phenomenon and damage to elements can be prevented. A plasma display apparatus according to an aspect of the present invention comprises a plasma display panel including a scan electrode and a sustain electrode, and a controller for applying a sustain pulse, which is the first applied pulse, to the scan electrode and the sustain electrode for a predetermined time after the plasma display panel is turned on. The present invention is advantageous in that it can obviate an afterimage occurring when a plasma display panel is turned on and can prevent an erroneous discharge phenomenon and damage to elements by improving a driving apparatus of the plasma display panel.

9 Claims, 7 Drawing Sheets

RELATED ART

RELATED ART

RELATED ART

PLASMA DISPLAY APPARATUS AND DRIVING METHOD THEREOF

CROSS-REFERENCES TO RELATED APPLICATIONS

This Nonprovisional application claims priority under 35 U.S.C. §119(a) on Patent Application No. 10-2004-0111543 filed in Republic of Korea on Dec. 23, 2004, the entire contents of which are hereby incorporated by reference.

BACKGROUND OF THE INVENTION

1. Field of the Invention

The present invention relates to a plasma display panel and, more particularly, to a plasma display apparatus and driving method thereof, in which an afterimage occurring when the plasma display panel is turned on can be obviated and an erroneous discharge phenomenon and damage to elements can be prevented.

2. Background of the Related Art

In general, a plasma display panel comprises a front substrate and a rear substrate. A barrier rib formed between the front substrate and the rear substrate forms one unit cell. Each cell is filled with a primary discharge gas, such as neon (Ne), helium (He) or a mixed gas of Ne+He, and an inert gas containing a small amount of xenon (Xe). If the inert gas is discharged with a high frequency voltage, vacuum ultraviolet rays are generated. Phosphors formed between the barrier ribs are excited to display images. The plasma display panel can be made thin, and has thus been in the spotlight as the next-generation display devices.

FIG. 1 shows the construction of a general plasma display panel.

As shown in FIG. 1, the plasma display panel comprises a front substrate 100 and a rear substrate 110. In the front substrate 100, a plurality of sustain electrode pairs in which scan electrodes 102 and sustain electrodes 103 are formed in pairs is arranged on a front glass 101 serving as a display surface on which images are displayed. In the rear substrate 110, a plurality of address electrodes 113 crossing the plurality of sustain electrode pairs is arranged on a rear glass 111 serving as a rear surface. At this time, the front substrate 100 and the rear substrate 110 are parallel to each other with a predetermined distance therebetween.

The front substrate 100 comprises the pairs of scan electrodes 102 and sustain electrodes 103, which mutually discharge one another and maintain the emission of a cell within one discharge cell. In other words, each of the scan electrode 102 and the sustain electrode 103 has a transparent electrode (a) formed of a transparent ITO material and a bus electrode (b) formed of a metal material. The scan electrodes 102 and the sustain electrodes 103 are covered with one or more dielectric layers 104 for limiting a discharge current and providing insulation among the electrode pairs. A protection layer 105 having Magnesium Oxide (MgO) deposited thereon is formed on the dielectric layers 104 so as to facilitate discharge conditions.

In the rear substrate 110, barrier ribs 112 of stripe form (or well form), for forming a plurality of discharge spaces, i.e., discharge cells are arranged parallel to one another. Furthermore, a plurality of address electrodes 113, which generate vacuum ultraviolet rays by performing an address discharge, are disposed parallel to the barrier ribs 112. R, G and B phosphor layers 114 that radiate a visible ray for displaying images during an address discharge are coated on a top surface of the rear substrate 110. A dielectric layer 115 for protecting the address electrodes 113 is formed between the address electrodes 113 and the phosphor layers 114.

In the plasma display panel constructed above, discharge cells are formed in plural in a matrix structure. A driving module having a driving circuit for providing a predetermined pulse is attached to the discharge cells to form a driving apparatus. The coupling relation between the plasma display panel and the driving module will be described with reference to FIG. 2.

FIG. 2 is a view for illustrating a driving apparatus of the plasma display panel in the related art. As shown in FIG. 2, the driving apparatus of the plasma display panel in the related art has discharge cells, which are formed in plural in matrix form, attached to the plasma display panel, so that a predetermined pulse is supplied to the discharge cells.

The driving apparatus of the plasma display panel comprises a data aligner 200, a timing controller 201, a data driver 202, a scan driver 203 and a sustain driver 204, as shown in FIG. 2.

The data aligner 200 of the driving apparatus in the related art aligns externally input image data and applies them to respective address electrodes X1 to Xm. The aligned data are supplied to the address electrodes X1 to Xm of the plasma display panel 205 through the data driver 202.

Furthermore, the scan driver 203 applies a scan signal and a sustain signal to scan electrodes Y1 to Yn under the control of the timing controller 201. The sustain driver 204 applies a sustain signal to each of sustain electrodes Z under the control of the timing controller 201. Through this process, the plasma display panel 205 is driven. A method of implementing gray levels of an image in the plasma display panel constructed above will be described below with reference to FIG. 3.

FIG. 3 is a view for illustrating a method of implementing gray levels of an image in the plasma display panel in the related art.

As shown in FIG. 3, in order to represent image gray levels of the plasma display panel in the related art, one frame is divided into several sub-fields having a different number of emissions. Each of the sub-fields is divided into a reset period (RPD) for initializing the entire cells, an address period (APD) for selecting a cell to be discharged, and a sustain period (SPD) for implementing gray levels depending on the number of discharges.

For example, if it is sought to display images with 256 gray levels, a frame period (16.67 ms) corresponding to 1/60 seconds is divided into eight sub-fields (SF1 to SF8) as shown in FIG. 2. Each of the eight sub-fields (SF1 to SF8) is again divided into a reset period, an address period and a sustain period.

The reset period and the address period of each sub-field are the same every sub-field. An address discharge for selecting a cell to be discharged is generated because of a voltage difference between the address electrodes and the scan electrodes (i.e., transparent electrodes). The sustain period is increased in the ratio of $2^n$ (where n=0, 1, 2, 3, 4, 5, 6, 7) in each sub-field.

Since the sustain period is varied every sub-field as described above, gray levels of an image are represented by controlling the sustain period of each sub-field, i.e., a sustain discharge number. A driving waveform depending on the driving method of the plasma display panel will be described below with reference to FIG. 4.

FIG. 4 shows a driving waveform depending on the driving method of the plasma display panel in the related art.

As shown in FIG. 4, the plasma display panel is driven with one frame being divided into a reset period for initializing the entire cells, an address period for selecting a cell to be discharged, a sustain period for sustaining the discharge of the selected cell and an erase period for erasing wall charges within discharged cells.

The reset period is divided into a setup period and a setdown period.

In the setup period of the reset period, a ramp-up waveform (Ramp-up) is applied to the entire scan electrodes at the same time. The ramp-up waveform generates a weak dark discharge within discharge cells of the entire screen. The setup discharge causes positive wall charges to be accumulated on the address electrodes and the sustain electrodes, and negative wall charges to be accumulated on the scan electrodes.

In the setdown period of the reset period, after the ramp-up waveform is applied, a ramp-down waveform (Ramp-down), which starts falling from a positive voltage lower than a peak voltage of the ramp-up waveform up to a predetermined voltage level lower than a ground (GND) level voltage, generates a weak erase discharge within cells, thereby sufficiently erasing wall charges excessively formed on the scan electrodes. The setdown discharge causes wall charges of the degree in which an address discharge can occur stably to uniformly remain within the cells.

In the address period, while negative scan pulses are sequentially applied to the scan electrodes, data pulses of a positive voltage (Va) is applied to the address electrodes in synchronization with the scan pulse. As a voltage difference between the scan pulse and the data pulse and a wall voltage generated in the reset period are added, an address discharge is generated within discharge cells to which the data pulse is applied. Furthermore, wall charges of the degree in which a discharge can be generated when a sustain voltage (Vs) is applied are formed within cells selected by an address discharge. The sustain electrodes are supplied with a positive voltage (Vz) such that an erroneous discharge is not generated between the sustain electrodes and the scan electrodes by reducing between the sustain electrodes and the scan electrodes during the setdown period and the address period.

In the sustain period, a sustain pulse (sus) is alternately applied to the scan electrodes and the sustain electrode. In cells selected by an address discharge, a sustain discharge, i.e., a display discharge is generated between the scan electrodes and the sustain electrodes whenever the sustain pulse is applied as the wall voltage within the cell and the sustain pulse are added.

After the sustain discharge is finished, in the erase period, a voltage of an erase ramp waveform (Ramp-ers) having a narrow pulse width and a low voltage level is applied to the sustain electrodes, thereby erasing wall charges remaining within the cells of the entire screen.

Meanwhile, if a normal driving pulse is input as soon as the plasma display panel is turned on, wall charges remain within respective cells of the plasma display panel with them being displayed. Thereafter, when the plasma display panel is turned on, if a normal driving pulse is input, a problem arises because an afterimage of the degree in which a human being can see the screen, which was being displayed when the plasma display panel was turned off, appears due to the discharge of the remaining wall charges, which is incurred by the reset pulse of the driving pulse.

Furthermore, if a normal driving pulse is input as soon as the plasma display panel is turned on, the high voltages (Vs, Va) for applying the driving pulse are instantly applied. This generates an erroneous discharge phenomenon. A problem also arises because elements can be damaged due to overload of the plasma display panel.

SUMMARY OF THE INVENTION

Accordingly, an object of the present invention is to solve at least the problems and disadvantages of the background art.

It is an object of the present invention to provide a plasma display apparatus and driving method thereof, in which they can obviate an afterimage occurring when the plasma display panel is turned on and can prevent an erroneous discharge phenomenon and damage to elements.

A plasma display apparatus according to an aspect of the present invention comprises a plasma display panel including a scan electrode and a sustain electrode, and a controller for applying a sustain pulse, which is the first applied pulse, to the scan electrode and the sustain electrode for a predetermined time after the plasma display panel is turned on.

According to another aspect of the present invention, there is provided a method of driving a plasma display apparatus including a plasma display panel having a scan electrode and a sustain electrode, wherein a sustain pulse, which is the first applied pulse, is applied to the scan electrode and the sustain electrode for a predetermined time after the plasma display panel is turned on.

The present invention is advantageous in that it can obviate an afterimage occurring when a plasma display panel is turned on and can prevent an erroneous discharge phenomenon and damage to elements by improving a driving apparatus of the plasma display panel.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Preferred embodiments of the present invention will be described in a more detailed manner with reference to the drawings.

Figure 1:
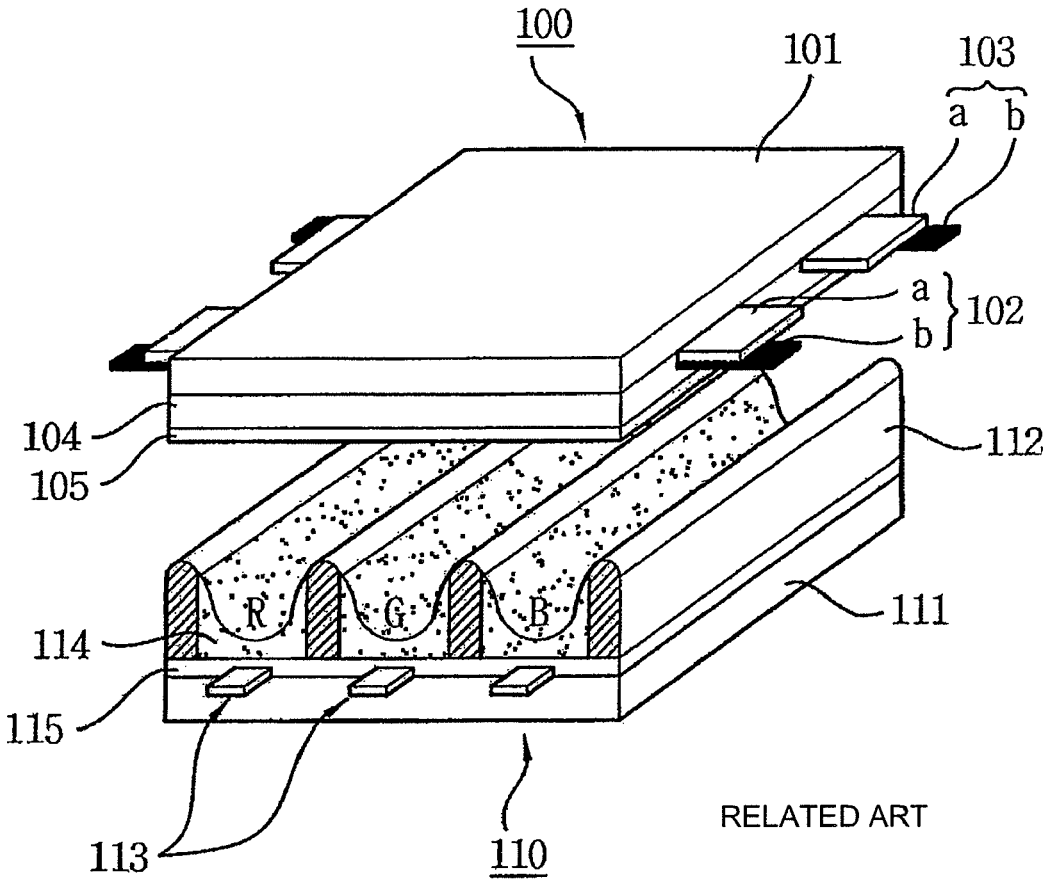
FIG. 1 shows the construction of a general plasma display panel.
Figure 2:
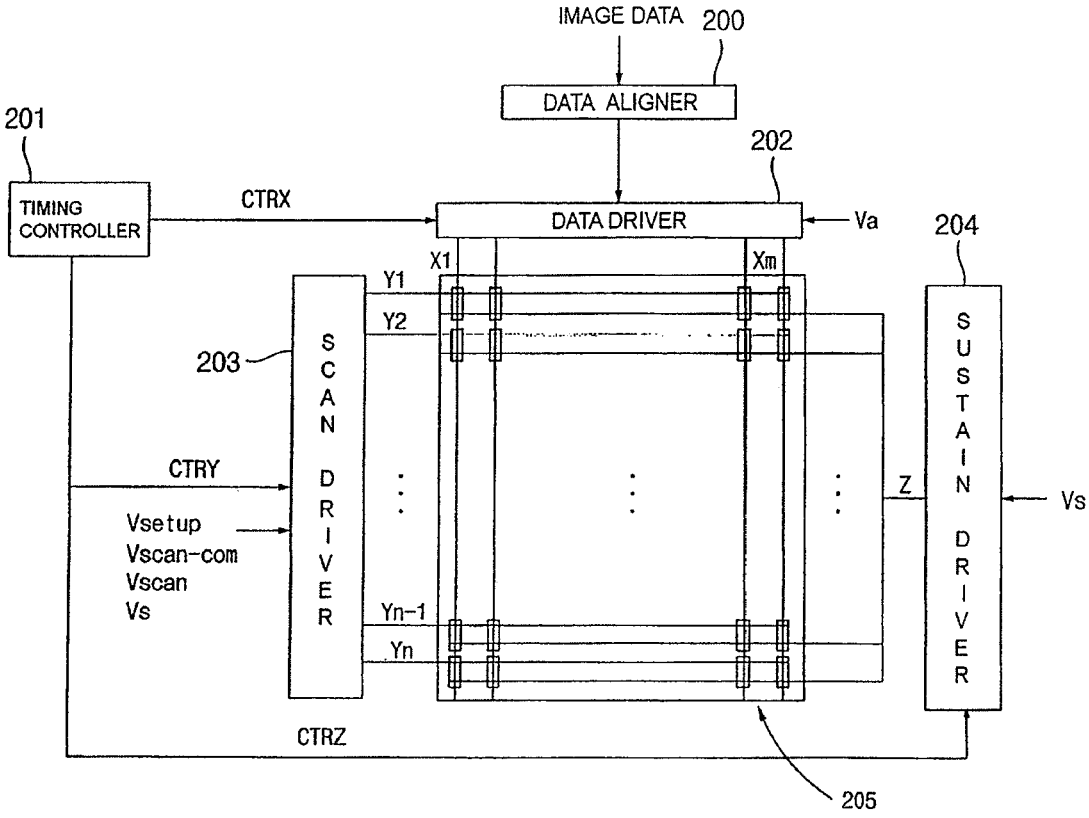
FIG. 2 is a view for illustrating a driving apparatus of the plasma display panel in the related art.
Figure 3:
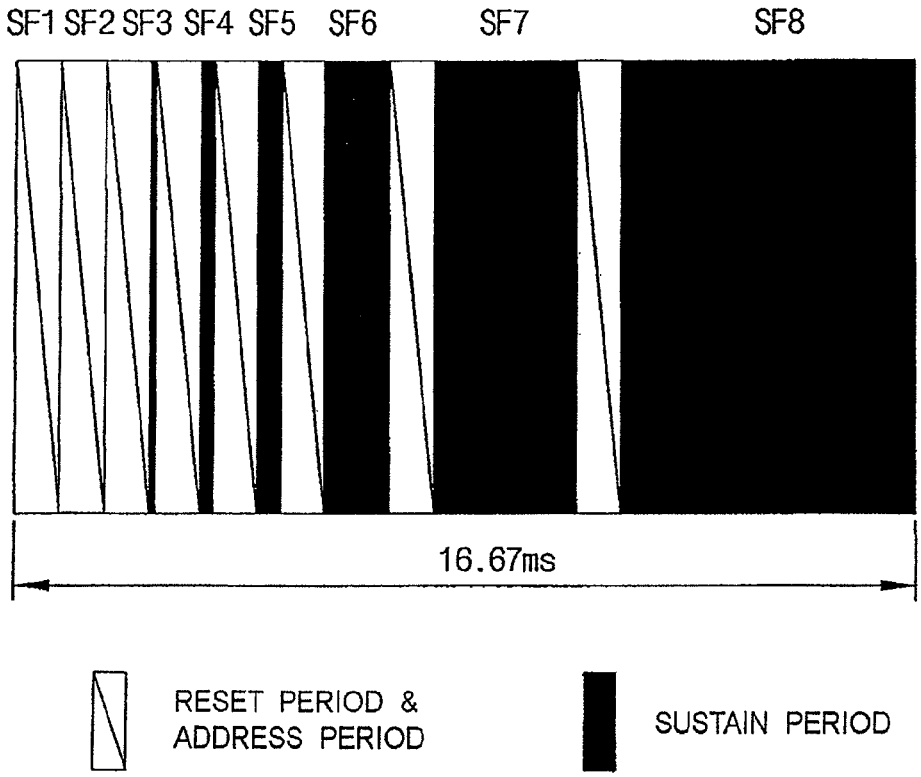
FIG. 3 is a view for illustrating a method of implementing image gray levels of the plasma display panel in the related art.
Figure 4:
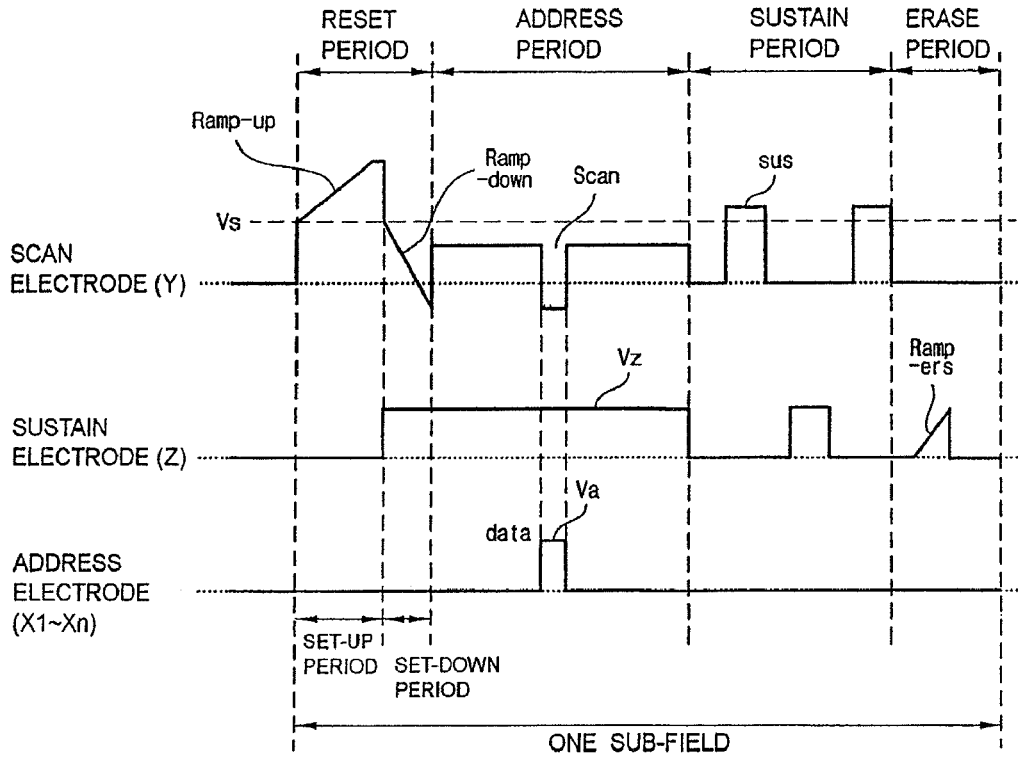
FIG. 4 shows a driving waveform depending on a driving method of the plasma display panel in the related art.
Figure 5:
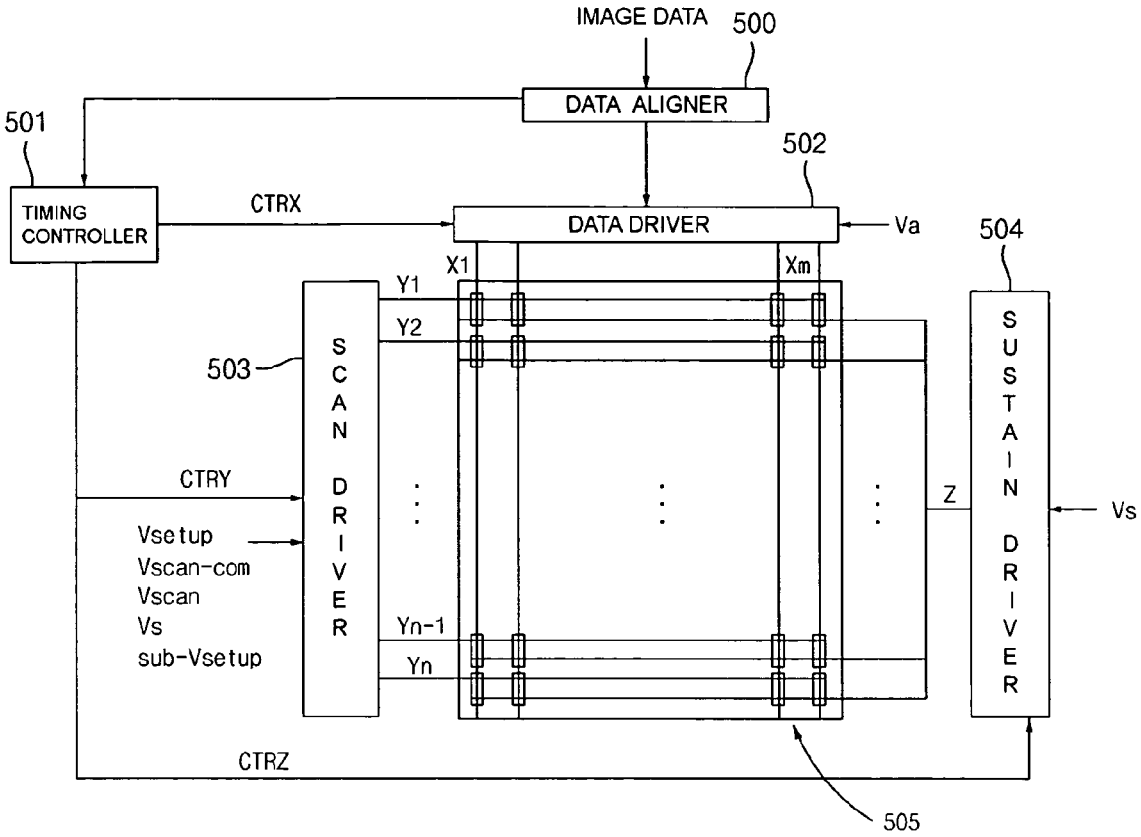
FIG. 5 is a view for illustrating a driving apparatus of a plasma display panel according to an embodiment of the present invention.

FIG. 5 is a view for illustrating a driving apparatus of a plasma display panel according to an embodiment of the present invention. As shown in FIG. 5, the driving apparatus of the plasma display panel according to an embodiment of the present invention comprises a data aligner 500, a timing controller 501, a data driver 502, a scan driver 503 and a sustain driver 504.

The data aligner 500 aligns externally input image data so that the aligned data can be applied to respective address electrodes X1 to Xm.

The data driver 502 applies address pulses of the aligned data to the address electrodes X1 to Xm of the plasma display panel 505.

The timing controller 501 controls pulse timings of the scan driver 503 and the sustain driver 504.

The scan driver 503 applies a scan pulse and a sustain pulse to each of scan electrodes Y1 to Yn.

The sustain driver 504 applies a sustain pulse to each of sustain electrodes Z. Through this process, the plasma display panel 505 is driven.

If the plasma display panel is turned off when being driven as described above, wall charges when the plasma display panel is turned off remain in each cell. Furthermore, energy stored in an energy storage unit (not shown) of an energy recovery circuit that supplies and recovers energy when the plasma display panel is driven is attenuated and becomes extinct.

The sustain driver 503 and the scan driver 504 according to an embodiment of the present invention alternately apply sustain pulses to the scan electrodes and the sustain electrodes before a reset period, i.e., before a normal driving pulse is applied according to a logic signal applied when the plasma display panel is turned on, so that energy can be store din the energy storage unit (not shown).

Furthermore, the scan driver 503 generates a sub-reset pulse that makes uniform the wall charge distribution of the plasma display panel before the normal driving pulse is applied after the sustain pulse is applied.

As described above, before a normal driving pulse is applied, energy can be sufficiently stored in the energy storage unit and the wall charge distribution of the plasma display panel can be made uniform. This will be described in more detail later on.

Figure 6:
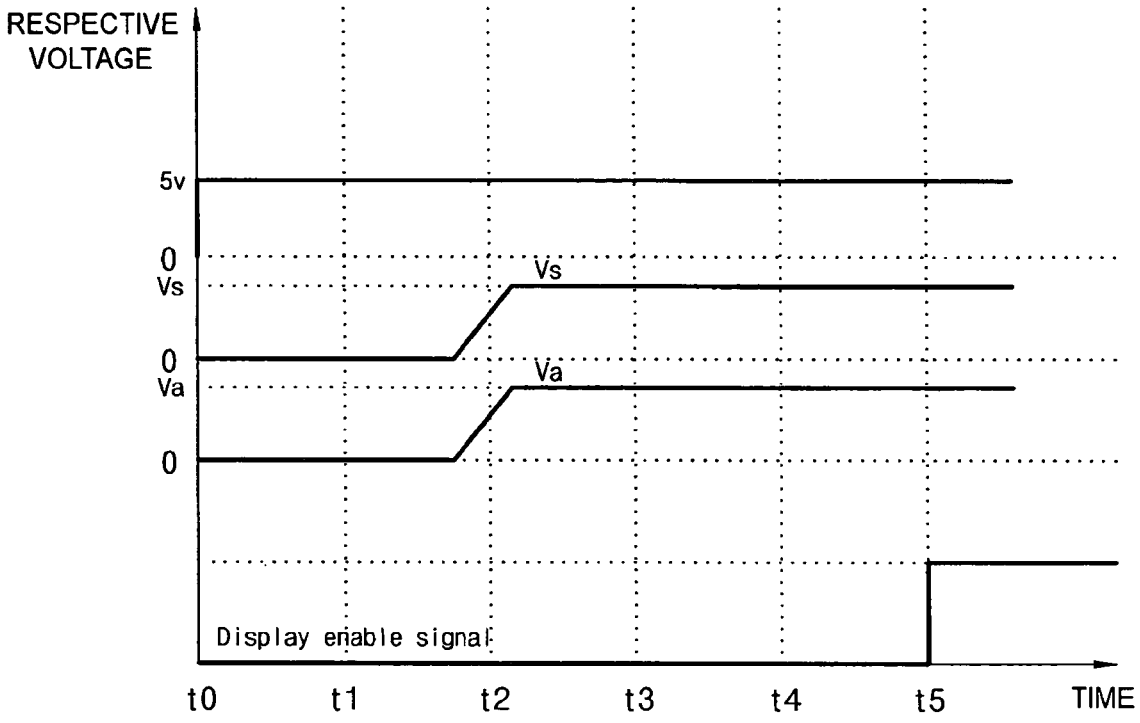
FIG. 6 is a waveform diagram for illustrating the power-on sequence of the plasma display panel according to an embodiment of the present invention.

FIG. 6 is a waveform diagram for illustrating the power-on sequence of the plasma display panel according to an embodiment of the present invention.

As shown in FIG. 6, in the power-on sequence according to an embodiment of the present invention, a logic signal (5V), a sustain voltage (Vs) and an address voltage (Va) are sequentially applied to the drivers when the plasma display panel is turned on.

As soon as the plasma display panel is turned on (t0), the logic signal (5V) is applied from a power supply unit (not shown) to each of the drivers.

After t2, the sustain voltage (Vs) is applied to the sustain driver or the scan driver and the address voltage (Va) is applied to the data driver.

After t5, the screen of the plasma display panel is displayed according to a display enable signal. That is, after the display enable signal is applied, a normal driving pulse is applied to each of the electrodes of the plasma display panel, so that the screen is displayed.

Therefore, in an embodiment of the present invention, during the power-on sequence period, a sustain pulse for charging energy and a sub-reset pulse for making uniform wall charges are applied. The sustain pulse and the sub-reset pulse will be described in more detail with reference to FIG. 7.

Figure 7:
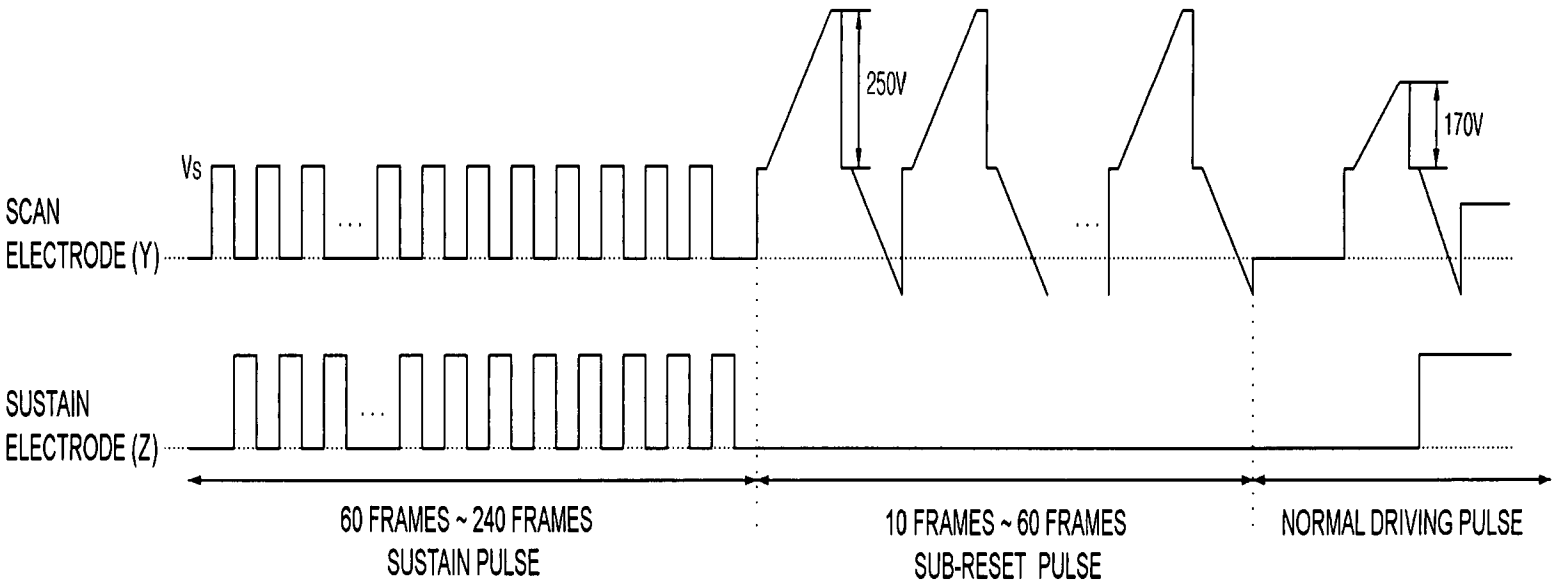
FIG. 7 is a waveform diagram for illustrating a sustain pulse and a sub-reset pulse applied when the plasma display panel is turned on according to an embodiment of the present invention.

FIG. 7 is a waveform diagram for illustrating a sustain pulse and a sub-reset pulse applied when the plasma display panel is turned on according to an embodiment of the present invention.

As shown in FIG. 7, in an embodiment of the present invention, the power-on sequence period comprises an energy charge period where a sustain pulse is applied and a sub-reset period where a sub-reset pulse is applied.

The sustain pulse applied during the energy charge period is alternately applied to the scan electrodes and the sustain electrodes. When the alternating sustain pulse is applied, a firing voltage is not applied. Therefore, a discharge is not generated and energy is sufficiently stored in the energy storage unit.

That is, the sustain pulse applied during the energy charge period according to an embodiment of the present invention is a pulse having a voltage level lower than the firing voltage and has a voltage level lower than that of the sustain pulse for a discharge, which is applied during a normal sustain period. Therefore, it can prevent an instant application of high voltages (Vs, Va) when the normal driving pulse is applied.

At this time, the sustain pulse is applied for 1 to 4 seconds, i.e., for 60 frames to 240 frames.

A setup waveform of a sub-reset pulse applied in a sub-reset period according to an embodiment of the present invention has a voltage level higher than that of a setup waveform of a reset pulse applied in a typical reset period. A waveform of a sub-reset pulse according to an embodiment of the present invention has a shape similar to that of a waveform of a reset pulse existing in a typical reset period. That is, the waveform of the sub-reset pulse has both a setup ramp pulse whose voltage gradually rises, and a setdown ramp pulse whose voltage level gradually falls. Furthermore, the sub-reset period consecutively exists in time series manner after the energy charge period.

Furthermore, the sub-reset pulse can be applied every frame. In addition, the number of sub-reset pulses applied every frame can be one or more. One sub-reset pulse can be preferably applied every frame. The sub-reset pulse is applied for ⅙ to 1 second and forms 10 frames to 60 frames.

The remaining wall charge distribution due to the turn-off of the plasma display panel can be sufficiently made uniform. It is thus possible to prohibit generation of an afterimage when a first reset pulse of a normal driving pulse is applied.

Meanwhile, in FIG. 7 according to an embodiment of the present invention, it has been shown that the waveform comprises both the energy charge period and the sub-reset period. The technical spirit of present invention is not limited to the above. In other words, according to the technical spirit of present invention, if the plasma display panel is turned on, only the energy charge period where the sustain pulse is alternately applied for a predetermined time period can exist, or only the sub-reset period where the reset pulse is applied for a predetermined time period can exist.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus for driving a plurality of frames comprising a plurality of sub-fields wherein a sub-field is divided into a reset period, an address period and a sustain period and the sub-fields are driven during a normal driving period, the plasma display apparatus comprising:

a plasma display panel comprising a scan electrode and a sustain electrode; and a controller configured to apply sub-sustain pulses to the scan electrode and the sustain electrode alternately, and to apply a plurality of consecutive sub-reset pulses to the scan electrode during a power-on sequence period including an energy charge period and a sub-reset period, the power-on sequence period beginning from when the plasma display apparatus is initially turned on and ending when the normal driving period begins, to display an image on a screen of the plasma display apparatus, wherein the sub-sustain pulses are applied during the energy charge period of the power-on sequence period, the sub-reset pulses are applied during the sub-reset period of the power-on sequence period, the normal driving period occurs after the completion of the power-on sequence period, and the power-on sequence period has a duration of plural frames, wherein each of the consecutive sub-reset pulses includes a first setup ramp pulse having a gradually increasing voltage, rising from a sustaining voltage level of the sub-sustain pulses applied during the energy charge period and having a maximum voltage level of the first setup ramp pulse higher than the sustaining voltage level of the sub-sustain pulses applied during the energy charge period, and a first setdown ramp pulse having a gradually decreasing voltage, falling from the sustaining voltage level of the sub-sustain pulses applied during the energy charge period and having a minimum voltage level of the first setup ramp pulse lower than ground voltage level, wherein the controller further applies a reset pulse during the reset period of the normal driving period of the sub-field, the reset pulse includes a second setup ramp pulse having a gradually increasing voltage, rising from the sustaining voltage level of the sub-sustain pulses applied during the energy charge period and having a maximum voltage level of the second setup ramp pulse higher than the sustaining voltage level of the sub-sustain pulses applied during the energy charge period and a second setdown ramp pulse having a gradually decreasing voltage, falling from the sustaining voltage level of the sub-sustain pulses applied during the energy charge period and having a minimum voltage level of the second setup ramp pulse lower than ground voltage level, and the maximum voltage level of the first setup ramp pulse is higher than the maximum voltage level of the second setup ramp pulse, wherein the energy charge period comes before the sub-reset period, the sub-sustain pulses are applied and the sub-reset pulses are omitted during the energy charge period, the sub-reset pulses are applied and the sub-sustain pulses are omitted during the sub-reset period, and the energy charge period is longer than the sub-reset period, and wherein at least two of the sub-reset pulses are applied to the scan electrode consecutively during the sub-reset period, and the sub-sustain pulses are omitted during the at least two of the sub-reset pulses applied consecutively.

2. The plasma display apparatus of claim 1, wherein the second period ranges from 10 frames to 60 frames.

3. The plasma display apparatus of claim 2, wherein the sub-reset pulses are applied in each of the frames.

4. The plasma display apparatus of claim 3, wherein the sub-reset pulses are applied with one sub-reset pulse in each of the frames.

5. A method of driving a plasma display panel driven with a plurality of frames comprising a plurality of sub-fields wherein a sub-field is divided into a reset period, an address period and a sustain period and the sub-fields are driven during a normal driving period, the method comprising:

applying sub-sustain pulses to a scan electrode and a sustain electrode alternately and applying a plurality of consecutive sub-reset pulses to the scan electrode during a power-on sequence period including an energy charge period and a sub-reset period, the power-on sequence period beginning from when the plasma display apparatus is initially turned on and ending when the normal driving period begins, to display an image on a screen of the plasma display panel, wherein the sub-sustain pulses are applied during the energy charge period of the power-on sequence period, the sub-reset pulses are applied during the sub-reset period of the power-on sequence period, the normal driving period occurs after the completion of the power-on sequence period, and the power-on sequence period has a duration of plural frames; and applying a reset pulse during the reset period of the normal driving period of the sub-field after the power-on sequence period, wherein each of the consecutive sub-reset pulses includes a first setup ramp pulse having a gradually increasing voltage, rising from a sustaining voltage level of the sub-sustain pulses applied during the energy charge period and having a maximum voltage level of the first setup ramp pulse higher than the sustaining voltage level of the sub-sustain pulses applied during the energy charge period, and a first setdown ramp pulse having a gradually decreasing voltage, falling from the sustaining voltage level of the sub-sustain pulses applied during the energy charge period and having a minimum voltage level of the first setup ramp pulse lower than ground voltage level, wherein the reset pulse includes a second setup ramp pulse having a gradually increasing voltage, rising from the sustaining voltage level of the sub-sustain pulses applied during the energy charge period and having a maximum voltage level of the second setup ramp pulse higher than the sustaining voltage level of the sub-sustain pulses applied during the energy charge period and a second setdown ramp pulse having a gradually decreasing voltage, falling from the sustaining voltage level of the sub-sustain pulses applied during the energy charge period and having a minimum voltage level of the second setup ramp pulse lower than ground voltage level, and the maximum voltage level of the first setup ramp pulse is higher than the maximum voltage level of the second setup ramp pulse, wherein the energy charge period comes before the sub-reset period, the sub-sustain pulses are applied and the sub-reset pulses are omitted during the energy charge period, the sub-reset pulses are applied and the sub-sustain pulses are omitted during the sub-reset period, and the energy charge period is longer than the sub-reset period, and wherein at least two of the sub-reset pulses are applied to the scan electrode consecutively during the sub-reset period, and the sub-sustain pulses are omitted during the at least two of the sub-reset pulses applied consecutively.

6. The method of claim 5, wherein the second period ranges from 10 frames to 60 frames.

7. The method of claim 5, wherein the sub-reset pulses are applied in each of the frames.

8. The method of claim 5, wherein the sub-reset pulses are applied with one sub-reset pulse in each of the frames.

9. The plasma display apparatus of claim 1, wherein, during the power-on sequence period, a logic signal is applied to a scan driver, a sustain driver and a data driver, and then a sustain voltage is applied to the scan driver or the sustain driver, and an address voltage is applied to the data driver.

* * * * *